US005240514A

United States Patent [19]

Yasuura et al.

[11] Patent Number: 5,240,514

[45] Date of Patent: Aug. 31, 1993

[54] METHOD OF ION NITRIDING STEEL WORKPIECES

[75] Inventors: Kiyomi Yasuura, Hiroshima; Katunori Hanakawa, Yamaguchi; Yoshihisa Miwa, Hiroshima, all of Japan

[73] Assignee: NDK, Incorporated, Tokyo, Japan

[21] Appl. No.: 770,011

[22] Filed: Sep. 30, 1991

[30] Foreign Application Priority Data

Sep. 28, 1990 [JP] Japan ..... 2-261102

[51] Int. Cl.[5] ..... C23C 8/38

[52] U.S. Cl. ..... 148/222; 148/226; 148/228; 427/569; 427/576; 204/192.16

[58] Field of Search ..... 148/222, 226, 228; 204/192.31, 192.16; 427/38, 39, 569, 576

[56] References Cited

U.S. PATENT DOCUMENTS

| | | | |
|---|---|---|---|
| 2,946,708 | 7/1960 | Berghaus et al. | 148/222 |
| 4,212,687 | 7/1980 | Tanaka et al. | 148/222 |
| 4,309,227 | 1/1982 | Kajikawa et al. | 148/222 |
| 4,394,234 | 7/1983 | Asahi et al. | 148/222 |
| 4,969,378 | 11/1990 | Lu et al. | 148/222 |

FOREIGN PATENT DOCUMENTS

| | | | |
|---|---|---|---|
| 55-11107 | 1/1980 | Japan . | |
| 55-38967 | 3/1980 | Japan . | |
| 55-41941 | 3/1980 | Japan . | |
| 60-17065 | 1/1985 | Japan . | |
| 61-31184 | 7/1986 | Japan . | |
| 61-142074 | 6/1989 | Japan | 204/192.31 |

OTHER PUBLICATIONS

Metals Handbook, 9th Ed., vol. 5 pp. 138–149, 417–421; 1982.

Chapman, Brian *Glow Discharge Processes; Sputtering and Plasma Etching;* 1980 pp. 77–82 115–124 QC 702.7P6; C48.

Metals Handbook 9th Edition, vol. 1, 1978 pp. 540–542, TA472A3.

*Primary Examiner*—R. Dean
*Assistant Examiner*—M. Phipps
*Attorney, Agent, or Firm*—Thompson, Hine and Flory

[57] ABSTRACT

In subjecting a steel workpiece to nitriding by glow discharge, formation of brittle nitrogen compound is restrained and the surface hardened layer with a nitrogen diffusion layer of high toughness is obtained by making the gas atmospheric condition the gas mixing ratio of $N_2:H_2=1:2-40$. By mixing Ar gas in the above gas atmospheric condition additionally, glow width is adjusted and glow discharge is allowed to enter into narrow concaves at the surface of a workpiece.

8 Claims, 5 Drawing Sheets

(×400)

(×400)

(×100)

(×100)

METHOD OF ION NITRIDING STEEL WORKPIECES

BACKGROUND OF THE INVENTION

1. Field of the Invention

This invention relates to a method of ion nitriding.

2. Description of the Prior Art

As a means of improving fatigue limit, pitting-resistance, etc. of steel structural parts for machine (workpiece), such as a transmission gear for automobile, a carburizing and quenching treatment has been known widely. However, the carburizing and quenching requires austenitization of a workpiece. This austenitization results in causing the so-called thermal strain on a workpiece and in the case of transmission gear, it can cause vibration and noises.

On the other hand, as a means of a surface treating means which involves less thermal strain, a method of ion nitriding has been known. In the conventional ion nitriding method, however, a nitrogen compound layer ($Fe_4N$) is formed at the outermost surface of a workpiece and a nitrogen diffusion layer is formed thereunder. As this nitrogen compound layer is hard and brittle, in the case of the transmission gear which is used under severe conditions, for example, the nitrogen compound layer (about 15$\mu$) at the surface exfoliates under high stress and abnormal wear takes place. Furthermore, the nitrogen compound layer cracks and such cracks spread to the diffusion layer, with the result that pitting is caused. As compared with a workpiece subjected to a carburizing treatment, a workpiece subjected to a nitriding treatment is thin in its hardened layer at the surface and therefore plastic deformation takes place by external force at or about a boundary between the hardened layer and a base metal. Thus, internal cracks occur and spalling is caused.

Japanese Patent Application Publication Gazette No. 61-31184 refers to a soft-nitriding treatment, more particularly, after a workpiece was hot-processed, metal structure is adjusted by controlled cooling and then a nitriding treatment is carried out. According to this method, it is possible to enlarge the hardened depth from the surface of a workpiece and to improve pitting-resistance and so on.

In the above soft nitriding treatment, however, a pre-treatment of a workpiece becomes complicated. It may be possible to deepen the surface hardened layer by making the nitriding treatment duration longer but this is unfavorable from productivity point of view.

SUMMARY OF THE INVENTION

An object of the present invention is to provide a method of ion nitriding, more particularly, manufacturing of nitriding steel having improved pitting-resistance and spalling-resistance by a comparatively simple treating process and in comparatively short nitriding time. Another object of the present invention is to form a hardened layer accurately even in concaves of small width at the surface of a workpiece.

In order to attain the above object, in the present invention formation of a hard and brittle nitrogen compound layer is restricted by adjusting the mixing ratio of $N_2$ gas and $H_2$ gas which form gas atmospheric condition at ion nitriding so as to obtain a hardened layer with a diffusion layer as a main body. By mixing Ar gas additionally for forming the gas atmospheric condition mentioned above, glow width of glow discharge is regulated and also the hardened layer can be formed certainly even in concaves of small width at the surface of a workpiece.

The method of ion nitriding according to the present invention is characterized in that a nitriding treatment is given to a steel workpiece by glow discharge in gas atmospheric condition with the gas mixing ratio (capacity ratio) of $N_2$:$H_2$=1:2–40, in which Ar gas is mixed additionally.

Re. $N_2$ gas and $H_2$ gas:

In the above ion nitriding method, by adopting the mixing ratio of $N_2$ and $H_2$ gas 1:2–40, generation of nitrogen compound can be restricted and a surface hardened layer with a nitrogen diffusion layer as main body can be obtained.

$N_2$ gas is a chemical element indispensable for nitriding. It is ionized by glow discharge and N atom diffuses inwardly from the surface of a workpiece, whereby a solid solution comprising N atom with Fe atom lattices therebetween, namely, surface hardened layer, is formed.

On the other hand, $H_2$ gas is ionized by glow discharge and a workpiece is heated by ion impulse (application of hydrogen ion to the surface of a workpiece), whereupon the surface of a workpiece is purified. $NH_3$ is generated by chemical bonding of H atom into a workpiece is promoted, while generation of nitrogen compound is being restricted.

Nitrogen compound is generated by deposition of $Fe_4n$, which was generated by Fe atom flied out by ion impulse and N atom mentioned above, at the surface of workpiece. In the case of the present invention, however, because of larger quantity of $H_2$ gas N atom is liable to generate $NH_3$ by reaction to H atom and accordingly reaction of N atom to Fe atom is restricted. $NH_3$ generated decomposes at the surface of a workpiece and N atom diffuses into steel.

In the above case, if the mixing ratio of $N_2$ gas and $H_2$ gas is larger than $\frac{1}{2}$, nitrogen compound is easy to be generated, namely, a nitrogen compound layer having the thickness of more than 5$\mu$ m is generated in a short time, without satisfactory diffusion of nitrogen in a workpiece, and as a result, it becomes difficult to obtain the desired pitting-resistance and spalling-resistance. On the other hand, if the mixing ratio of $N_2/H_2$ is less than 1/41, time of nitriding treatment required for obtaining the desired hardened layer becomes longer. This is undesirable.

Re. Ar gas:

By making the ratio of $N_2/H_2$ smaller, stabilization of glow discharge can be obtained but width of glow becomes broader, with the result that glow discharge is difficult to enter into narrow concaves at the surface of a workpiece.

On the other hand, regulation of gas atmospheric condition by mixing of Ar gas (as diluting gas) is effective for controlling the width of glow, more particularly, width of glow can be narrowed by addition of Ar gas and glow discharge is allowed to enter into such narrow concaves. Thus, the desired surface hardened layer can be obtained.

In the above case, it is preferable to regulate the gas atmospheric condition so that the gas mixing ratio becomes $N_2$:$H_2$:Ar=1:2–40:4–5. By this gas mixing ratio, glow width of glow discharge can be adjusted to 1–3 mm. The glow width of less than 3 mm makes it possible to effect nitriding even for narrow concaves at the surface of structural parts for machine. However, while it is difficult to make glow width less than 1 mm, such glow of narrow width can cause inferior nitriding.

Re: workpiece:

Nitriding steel, stainless steel, etc. in various kinds are available as workpiece. As nitriding steel, steel containing Cr, Mo and V is suitable. The amount to be added of each of Cr, Mo and V is as follows.

Cr: 0.50–1.30 weight %

Cr is an element for improving hardenability and for promoting diffusion of nitrogen. In order to obtain such effects, it is preferable to add Cr at 0.50 weight % or more. However, if the amount of addition exceeds 1.30 weight %, hardenability becomes excessive.

Mo:0.05–0.50% weight %

Mo is an important element for improving hardenability after hot forging. In order to obtain such effects, it is preferable to add Mo at 0.05% or more. However, if the amount of addition exceeds 0.50%, its effect is saturated and processability is impaired.

V:0.05–0.20%

V generates CN compound by bonding with carbon and nitrogen in a workpiece. It improves hardness of base material and also enlarges the effective hardened depth by generating nitride and nitriding process. In order to obtain such effect, it is preferable to add V at 0.05% or more. However, if the amount of addition exceeds 0.20%, toughness and processability are lowered.

Re. shot-peening:

If a workpiece is subjected to shot-peening after ion nitriding, no crack is caused at the surface of a workpiece and fatigue limit and pitting-resistance are improved still further. Thus, shot-peening is a more effective means of improving fatigue limit and pitting-resistance of a workpiece.

In the above ion nitriding, a surface hardened layer with a nitrogen diffusion layer as main body is formed, while generation of nitrogen compound is restricted, and therefore shot-peening can be given without causing cracks at the surface of a workpiece.

Preferable shot-peening conditions are as shown below.

Shot grain diameter: 0.02–0.8 mm

Material of shot: steel, glass, aluminum, etc.

Shot-peening speed: 50–120 m/second

In the above case, if the shot gain diameter is less than 0.02 mm, it is impossible to impart effective compressive residual stress to the surface. However, if it exceeds 0.8 mm, compressive residual stress can be imparted but damage on the surface of a workpiece becomes large. This is undesirable.

If the shot-peening speed is less than 50 m/sec., processing power proves insufficient but if it exceeds 120 m/sec., processing power becomes excessive and base material will be damaged. This is undesirable.

If the case where ion nitriding is imparted to steel gears, the following method is most suitable.

While a metal container with steel gears therein is being exhausted to the desired degree of vacuum, $N_2$ gas, $H_2$ gas and Ar gas are fed into the metal container. At this time, the gas mixing ratio should be adjusted to $N_2$:$H_2$ = 1:2–40 and the amount of Ar gas to be mixed in should be adjusted so that glow width of glow discharge becomes 1–3 mm. A nitrided layer is formed on the heated gear by impressing DC voltage between the metal container and the heated gear and thereby generating glow discharge.

By adjusting the glow width to 1–3 mm, glow discharge is allowed to enter into the tooth bottom of the gear and accordingly the desired surface hardened layer can be obtained, with resultant improvement of pitting-resistance and spalling resistance of the gear. The reason why the glow width is made 3 mm or less is that gears generally used have (in the case where number of teeth is 5–50) 1–3 modules and groove width of tooth bottom is about 3 mm. It is difficult to make the glow width less than 1 mm and that such narrow glow width can cause poor nitriding.

BRIEF DESCRIPTION OF THE DRAWINGS

The nature and advantage of the present invention will be understood more clearly from the following description made with reference to the accompanying drawings, in which.

DETAILED DESCRIPTION OF THE INVENTION

A description is made below of the preferred Embodiments of the present invention, on the basis of the accompanying drawings.

TEST 1

Re. Nitrogen Compound Layer

A material quality A (Cr-Mo-V Steel) having the composition shown in Table 1 as the main ingredients was subjected to hot forging as pre-treatment and then to normalizing at 900° C. so as to obtain plural rectangular test pieces (15×15×10 mm). Each of these test pieces was subjected to ion nitriding at different gas mixing ratios ($N_2$:$H_2$:Ar) and thickness of nitriding conditions are as shown below and the result obtained is shown in Table 2.

TABLE 1

| (Material quality A) (weight %) | | | | | |
|---|---|---|---|---|---|
| C | Si | Mn | Cr | Mo | V |
| 0.26 | 0.28 | 0.89 | 0.98 | 0.18 | 0.10 |

(Nitriding conditions)

TABLE 1-continued

| (Material quality A) (weight %) | |
|---|---|
| Nitriding temperature: | 570° C. |
| Treating time: | 12 Hr. |
| Degree of vacuum: | 4 Torr |

TABLE 2

| | gas mixing ratio | | | Thickness of | Width of |
|---|---|---|---|---|---|
| | $N_2$ | $H_2$ | Ar | Compound layer (μ) | glow (mm) |
| Embodiment 1 | 1 | 9 | 5 | 0 | 2.5 |
| Embodiment 2 | 1 | 4 | 5 | 1 | 2.3 |
| Embodiment 3 | 1 | 3 | 4 | 2 | 2.2 |
| Embodiment 4 | 1 | 2 | 4 | 4 | 1.8 |
| Embodiment 5 | 1 | 30 | 5 | 0 | 2.9 |
| Comparative Example 1 | 1 | 1 | nil | 15 | — |

Figure 7:
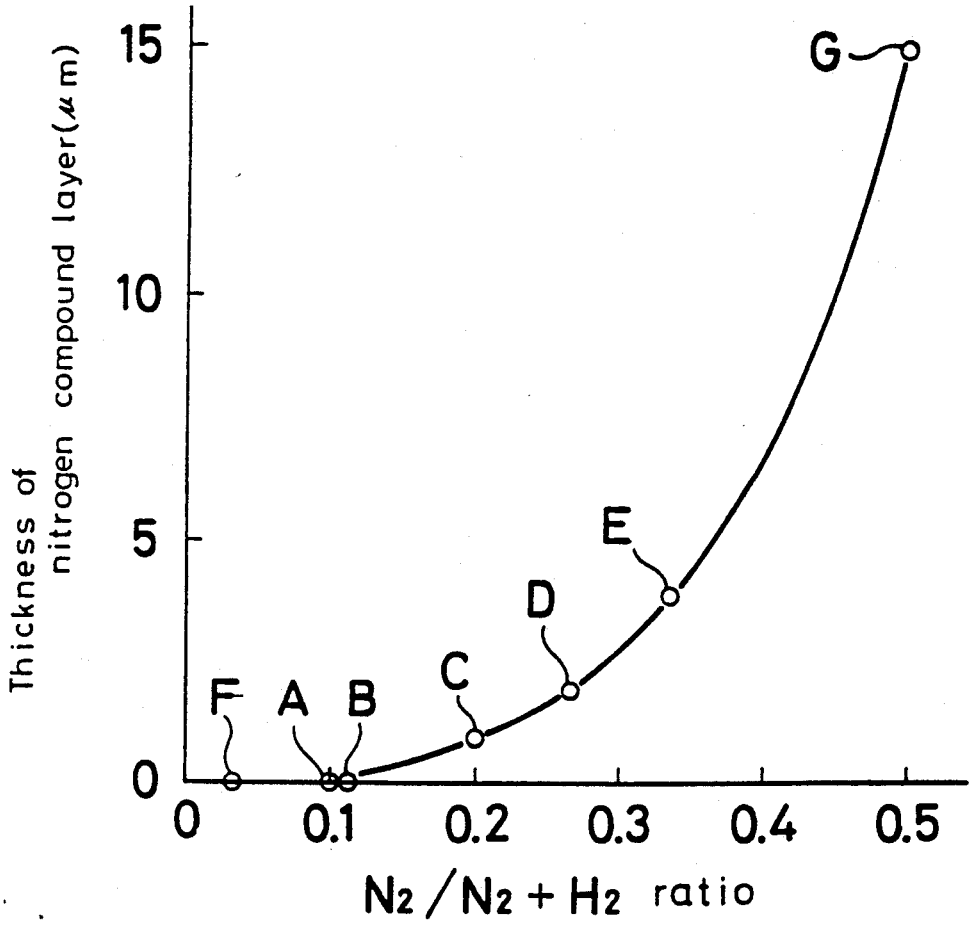
FIG. 7 is a characteristic drawing, showing the relation between the gas mixing ratio and thickness of the layer of nitrogen compound.

From the above result, it can be seen that the larger the gas ratio of $N_2/H_2$, the more the thickness of nitrogen compound layer. However, in the case of Embodiments, the gas ratio is N:H=1:2, far thinner than the case of Comparative Example and this means that restraint on generation of nitrogen compound is effected by making the gas ratio (N/H) smaller. As to thickness of nitrogen compound layer, it is shown by the relation with gas mixing ratio in FIG. 7. In FIG. 7, A, C, D and F correspond to Embodiment 1, 2, 3 and 5 respectively and G corresponds to Comparative Example 1.

Figure 1:
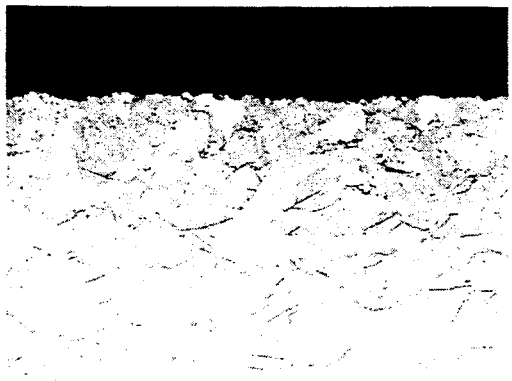
FIG. 1 is a microphotograph, showing a metal structure of the section of a surface layer part of a Embodiment 1.
Figure 2:
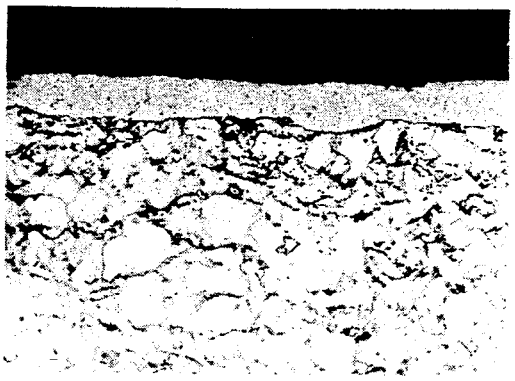
FIG. 2 is a microphotograph, showing a metal structure of the section of a surface layer part of a Comparative Example 1.
Figure 3:
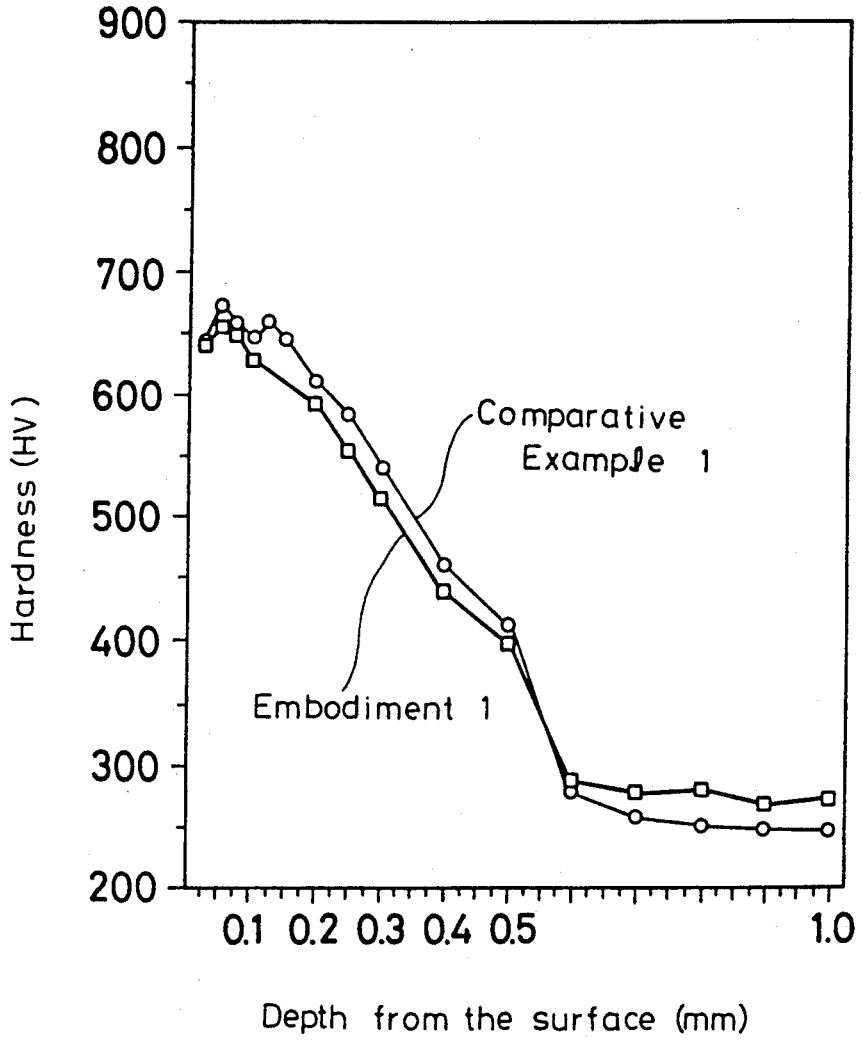
FIG. 3 is a characteristic drawing, showing the distribution of hardness of the surface layer part of Embodiment 1 and Comparative Example 1.

The metal structure (section) of the surface layer part of Embodiment 1 and Comparative Example 1 is shown in FIG. 1 and FIG. 2 respectively (400 magnifications). FIG. 3 shows the distribution of hardness of the surface layer part of Embodiment 1 and Comparative Example 1. in FIG. 2 (Comparative Example 1), the uppermost surface layer part is a nitrogen compound layer but in FIG. 1 (Embodiment 1), such nitrogen compound layer is not formed. As shown in FIG. 3, there is only little difference in the distribution of hardness between Embodiment 1 and Comparative Example 1 and in the case of Embodiment 1, satisfactory hardness is obtained in spite of no formation of nitrogen compound layer.

With regard to the gear having 30 teeth and module 1.75, it was subjected to nitriding under the same conditions of Embodiment 1 of Test 1, with the result that substantially the same distribution of hardness as shown in FIG. 3 at the tooth bottom was obtained.

TEST 2

Re. Influence by Material Quality

Figure 4:
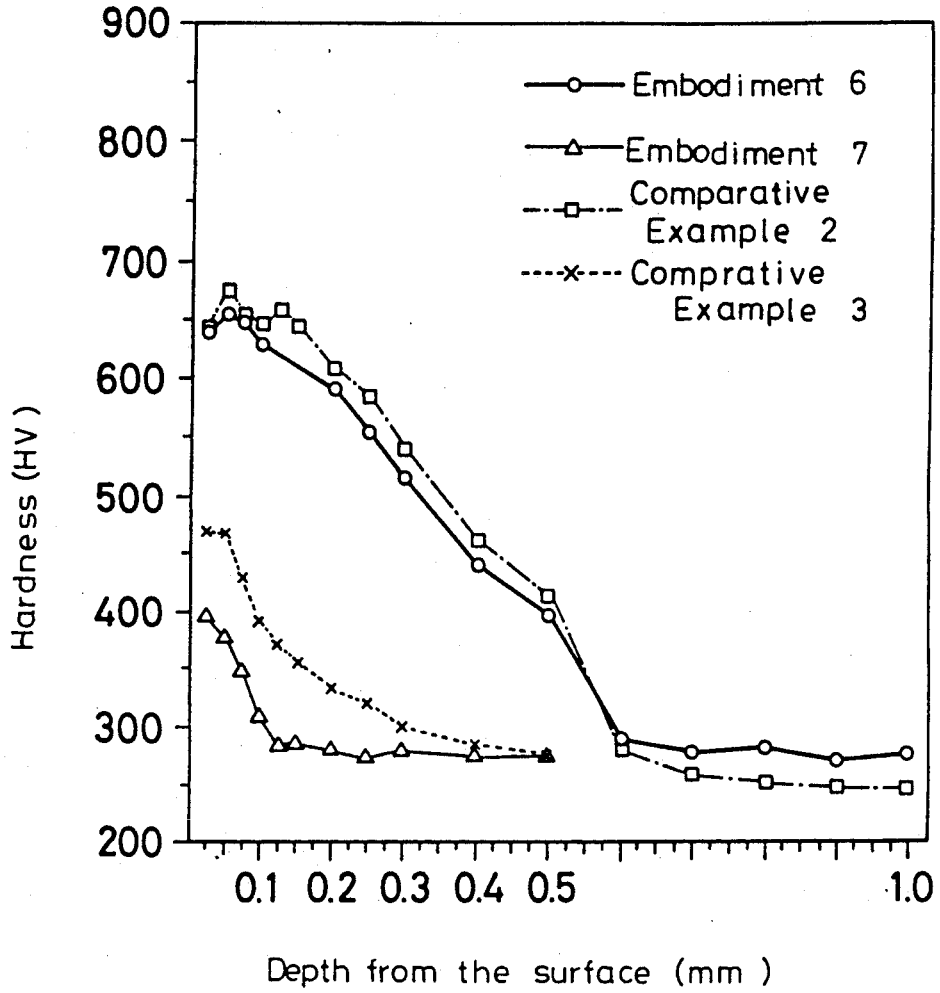
FIG. 4 is a characteristic drawing, showing the distribution of hardness of the surface layer part of workpieces of different materials.

Test pieces were made from material quality A shown in Table 1 and from material quality B (SCM 435) having the composition shown in Table 3 as the main ingredients by the same pre-treatment as in the case of Test 1. These test pieces were subjected to nitriding under the same conditions as in the case of Test 1 at gas mixing ratios shown in Table 4 and each test piece was measured for distribution of hardness of the surface layer part. The result is shown in FIG. 4.

TABLE 3

| (material quality B) (weight %) | | | | |
|---|---|---|---|---|
| C | Si | Mn | Cr | Mo |
| 0.35 | 0.19 | 0.75 | 1.03 | 0.22 |

TABLE 4

| Material quality | | Gas mixing ratio | | |
|---|---|---|---|---|
| | | $N_2$ | $H_2$ | Ar |
| A | Embodiment 6 | 1 | 8 | 4 |
| B | Embodiment 7 | 1 | 8 | 4 |
| A | Comparative Example 2 | 1 | 1 | nil |
| B | Comparative Example 3 | 1 | 1 | nil |

As can be seen from FIG. 4, there is only little difference in distribution of hardness between Embodiment 6 and Comparative Example 2, both using material quality A, and regarding material quality A, influence by the gas mixing ratio on distribution of hardness is slight.

In comparing Embodiment 7 using material quality B with Embodiment 6 using material quality A, Embodiment 7 has a thinner surface hardened layer and lower hardness at the uppermost surface part. In comparing Embodiment 7 with Comparative Example 3, both using the same material quality B, Embodiment 7 is thinner in surface hardened layer and lower in hardness at the uppermost surface part than Comparative Example 3.

The above result indicates that in the case of material quality A, it is superior in nitriding characteristic and is hardly affected by lowering of $N_2$ quantity. Thus, material quality A is suitable for working the present invention.

TEST 3

Re. Shot-Peening and Roller Pitting

Figure 5:
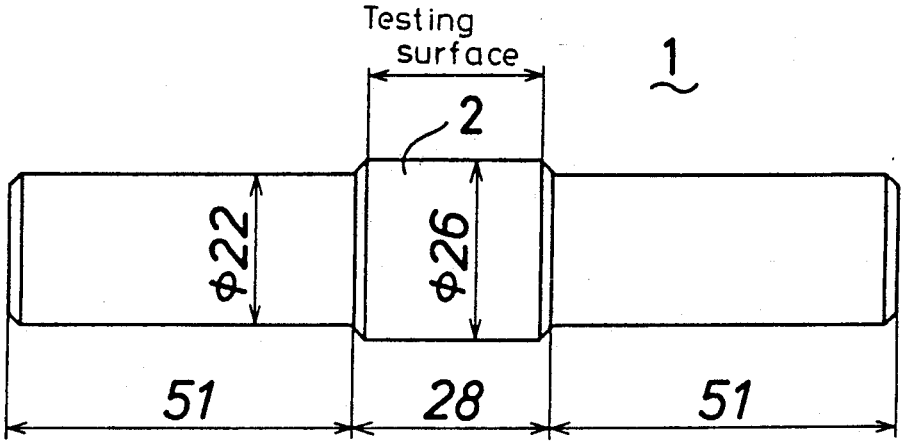
FIG. 5 is a front view, showing a test piece for pitting.

Test pieces 1 for pitting shown in FIG. 5 were made of material quality A shown in Table 1 by the same pre-treatment as in the case of Test 1. In this case, the central part 2 of a test piece is the testing surface. The central part 2 is 26 mm in diameter D and 28 mm in length L and both side 3 is 22 mm in diameter d and 51 mm in length l. Each test piece was subjected to nitriding under the conditions as shown in Table 5 and shot-peening was carried out under the conditions shown in table 6.

TABLE 5

| | Gas mixing ratio | | | Nitriding temperature and time |
|---|---|---|---|---|
| | $N_2$ | $H_2$ | Ar | |
| Embodiment 8 | 1 | 9 | 5 | 570° C. × 12 Hr. |
| Embodiment 9 | 1 | 8 | 4 | (4 Torr) |
| Embodiment 10 | 1 | 4 | 5 | |
| Embodiment 11 | 1 | 3 | 5 | |
| Comparative Example 4 | 1 | 1 | nil | |
| Comparative Example 5 | Gas soft nitriding | | | 570° C. × 3.5 Hr. |

TABLE 6

| Shot grain dia. | Material quality | Hardness of shot | Shot-peening speed |
|---|---|---|---|
| 0.5 mm | Steel | HRC 54 | 52 m/sec. |

Figure 6:
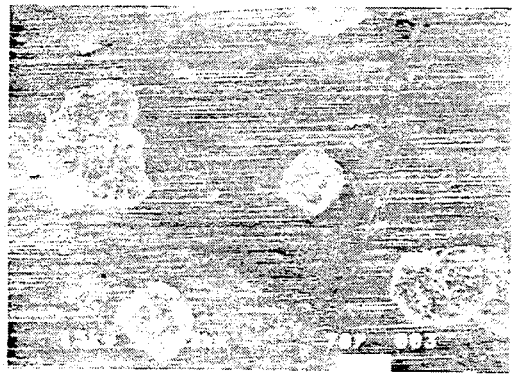
FIG. 6 is a photograph taken by a scanning type electron microscope, showing a metal structure of the surface of Comparative Example 5.

After shot-peening, the surface of test pieces was observed by using a scanning type electron microscope, with the result that exfoliation of the compound layer was found on the gas sort nitrided pieces of Comparative Example 5, as shown in FIG. 6 (100 magnifications).

Figure 8:
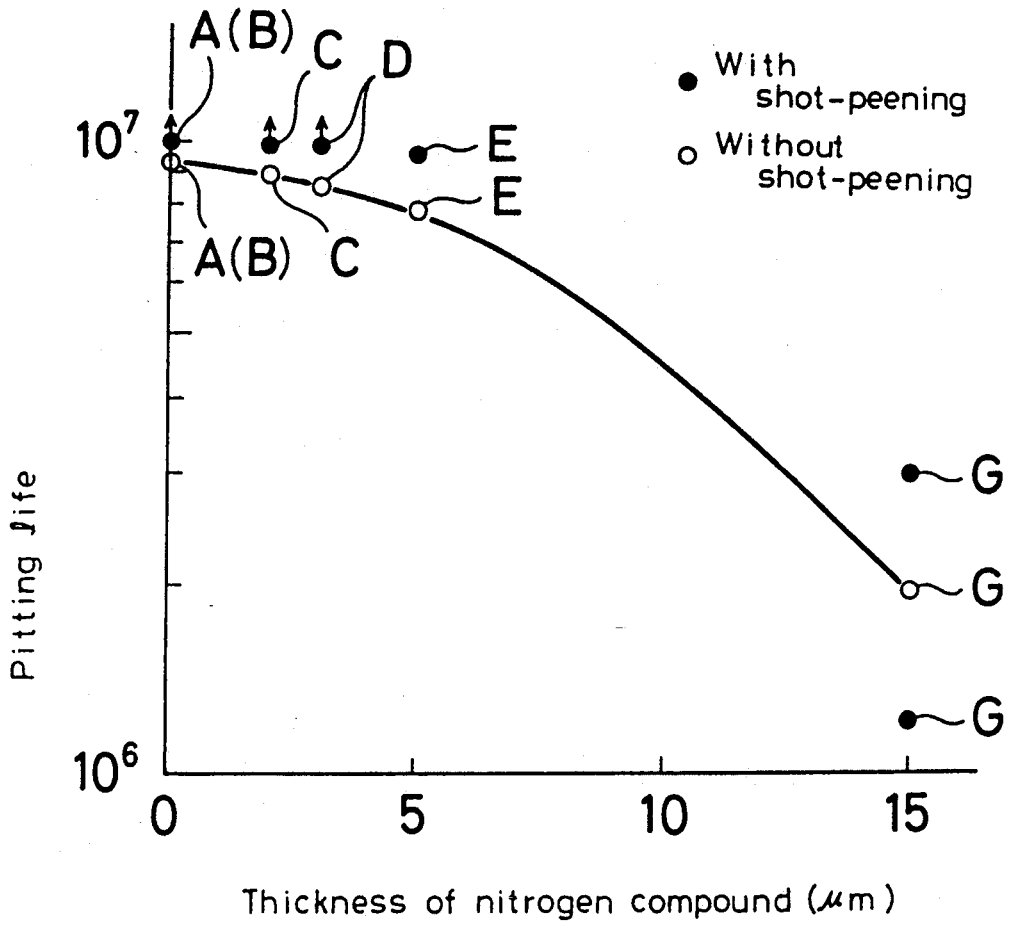
FIG. 8 is a characteristic drawing, showing the relation between thickness of the layer of nitrogen compound and pitting life.

Then, test pieces other than Comparative Example 5, with shot-peening and without shot-peening, were subjected to the roller-pitting test. This roller-pitting test was carried out under the main conditions of surface pressure 308 kgf/mm$^2$ and the sliding percentage of 60%. Thickness of nitrogen compound layer of each test piece is shown in FIG. 7 and pitting life (total number of revolutions) is shown in FIG. 8. A–G in FIG. 8 correspond to A–G in FIG. 7 respectively.

In the case of without shot-peening, while Comparative Example 4 showed the pitting life of $1.9\times10^6$, Embodiments 8, 9, 10 and 11 showed a long pitting life of more than $7.8\times10^6$. In the case of with shot-peening, each Embodiment showed higher pitting-resistance than in the case of without shot-peening.

Figure 9:
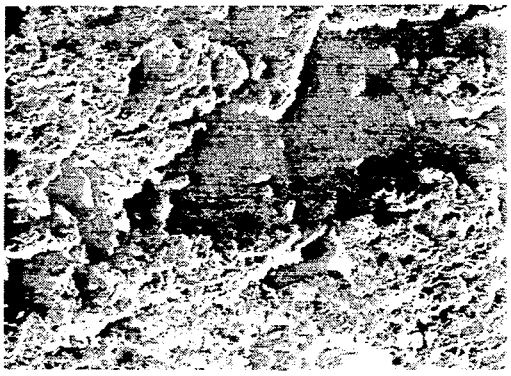
FIG. 9 is a photograph taken by a scanning type electron microscope, showing a metal structure of the surface of Comparative Example 4.

In the case of Comparative Example 4, some showed a longer pitting life and some showed a shorter pitting life. This phenomena may be attributed to cracking of nitrogen compound layer and it may be said that shot-peening is not desirable for those having a thick nitrogen compound layer. FIG. 9 shows the result of observation of the surface of test pieces of Comparative Example 4 by using a scanning type electron microscope (100 magnifications), from which it can be seen that pitting occurs partially with a nitrogen compound as a starting point. This is caused by that cracks take place at a brittle nitrogen compound during the pitting test and such cracks spread to the nitrogen diffusion layer. Thus, pitting life of Comparative Example 4 is shorter than those of Embodiments.

From the foregoing, it can safely be said that in the case of Embodiments, pitting-resistance is improved due to non-existence or thinness of nitrogen compound layer.

What is claimed is:

1. A method for ion-nitriding the surface of a metal workpiece which comprises the steps of:

exhausting a metal container having said metal workpiece therein, feeding a gaseous mixture of nitrogen, hydrogen and argon to said container in which the ratio of nitrogen to hydrogen is $N_2$:$H_2$=1:2–40, applying a voltage between said container and said workpiece such that said gaseous mixture is ionized by glow discharge and thereby form a nitride layer on the surface of said workpiece, wherein said workpiece is a steel workpiece that contains 0.5–1.3 weight percent Cr, 0.05–0.50 weight percent Mo, and 0.05–0.20 weight percent V.

2. The method of claim 1 wherein said argon gas is fed to said container in an amount such that the glow width of said glow discharge is about 1–3 mm.

3. The method of claim 2 wherein said gaseous mixture contains nitrogen, hydrogen and argon in an amount sufficient to provide a ratio of $N_2$:$H_2$:Ar=1:2-40:4-5.

4. The method of claim 1 wherein said method additionally includes a step of subjecting said workpiece to shot-peening.

5. A method for ion nitriding the surface of a steel gear comprising the steps of placing said steel gear in a metal container, exhausting said metal container, feeding a gaseous mixture of nitrogen, hydrogen, and argon to said metal container wherein the ratio of nitrogen to hydrogen is $N_2$:$H_2$=1:2–40, and applying a voltage between said metal container and said gears to cause said gaseous mixture to ionize by glow discharge and thereby form a nitride surface on said gears, wherein said gear contains 0.5–1.3 weight percent Cr, 0.05–0.50 weight percent Mo, and 0.05–0.20 weight percent V.

6. The method of claim 5 wherein said argon gas is fed to said container in an amount such that the glow width of said glow discharge is about 1–3 mm.

7. The method of claim 6 wherein said gaseous mixture contains nitrogen, hydrogen and argon in an amount sufficient to provide a ratio of $N_2$:$H_2$:Ar=1:2-40:4-5.

8. The method of claim 5 wherein said method additionally includes a step of subjecting said gear to shot-peening.

* * * * *